US011905082B2

(12) United States Patent
Brozell

(10) Patent No.: US 11,905,082 B2
(45) Date of Patent: Feb. 20, 2024

(54) CHILD-RESISTANT, PRESSURIZABLE, AND RESEALABLE PACKAGE

(71) Applicant: Owens-Brockway Glass Container Inc., Perrysburg, OH (US)

(72) Inventor: Brian Brozell, Maumee, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 9 days.

(21) Appl. No.: 17/543,916

(22) Filed: Dec. 7, 2021

(65) Prior Publication Data

US 2023/0174277 A1 Jun. 8, 2023

(51) Int. Cl.

| | |
|---|---|
| ***B65D 50/04*** | (2006.01) |
| ***B65D 41/12*** | (2006.01) |
| ***B65D 41/62*** | (2006.01) |
| ***A47G 19/22*** | (2006.01) |

(52) U.S. Cl.

CPC ..... *B65D 50/041* (2013.01); *A47G 19/2205* (2013.01); *B65D 41/12* (2013.01); *B65D 41/62* (2013.01); *B65D 2215/00* (2013.01); *B65D 2251/0015* (2013.01); *B65D 2251/0078* (2013.01)

(58) Field of Classification Search

CPC ..... B65D 50/041; B65D 41/12; B65D 41/62; B65D 2215/00; B65D 2251/0015; B65D 2251/0078; B65D 51/18

See application file for complete search history.

(56) References Cited

U.S. PATENT DOCUMENTS

| | | | | |
|---|---|---|---|---|
| 2,980,274 | A * | 4/1961 | Gould | B65D 50/041 215/220 |
| 3,559,833 | A | 2/1971 | Alonso | |
| 3,812,990 | A | 5/1974 | Willis | |
| 3,853,236 | A | 12/1974 | Ostrowsky | |
| 4,069,935 | A * | 1/1978 | Hampel | B65D 50/041 220/377 |
| 4,091,949 | A * | 5/1978 | Fowles | B65D 50/067 215/253 |
| 4,487,325 | A * | 12/1984 | Willingham | B65D 41/0435 215/350 |
| 4,598,833 | A | 7/1986 | Herr | |
| 4,892,209 | A | 1/1990 | Dorfman et al. | |
| 6,158,609 | A * | 12/2000 | Kaiser | B60R 11/00 220/3.9 |
| 6,672,469 | B2 | 1/2004 | Hessbrueggen et al. | |
| 2007/0158297 | A1 | 7/2007 | Querbach | |
| 2014/0263336 | A1 | 9/2014 | Hicks et al. | |

* cited by examiner

*Primary Examiner* — Shawn M Braden

(57) ABSTRACT

A package includes a container with a crown closure bead and an external thread segment having a diameter greater than that of the crown closure bead, a crown closure coupled to the crown closure bead, and a multi-piece closure assembly coupled to the crown closure and the container. The closure assembly includes an inner shell, a seal liner carried by the inner shell and positioned against the crown closure, and an outer shell. The inner shell has an inner skirt having at least one internal thread segment to cooperate with the external thread segment of the container. The outer shell has an outer skirt with an internal retention bead for cooperating with an external retention bead of the inner shell to retain the shells together in an axial direction, and outer child-resistant engagement features to cooperate with inner child-resistant engagement features of the inner shell.

21 Claims, 4 Drawing Sheets

CHILD-RESISTANT, PRESSURIZABLE, AND RESEALABLE PACKAGE

TECHNICAL FIELD

This patent application discloses innovations to packages and, more particularly, child-resistant food or beverage packages.

BACKGROUND

A typical food or beverage package includes a container and a closure removably coupled to the container. Many such packages include features that render the packages child-resistant, tamper-evident, pressurizable, or resealable. Few packages have more than two of the aforementioned features, and very few have all four. U.S. Pat. No. 4,487,326 discloses one such example. Although such packages may be commercially acceptable, the present inventors have recognized that some closure assembly designs are unnecessarily complex, costly, or ineffective.

SUMMARY OF THE DISCLOSURE

A package includes a container including a neck terminating in a neck finish having a crown closure bead with a first outer diameter, and at least one external thread segment spaced axially away from the crown closure bead and having a second diameter greater than the first outer diameter of the crown closure bead. The package also includes a crown closure coupled to the crown closure bead of the container neck finish, and a multi-piece closure assembly coupled to the crown closure and the container neck finish. The closure assembly includes an inner shell including an inner base wall having an axially inboard surface, an inner skirt depending from the base wall and having at least one internal thread segment to cooperate with the at least one external thread segment of the container neck finish and also having at least one external retention bead, and inner child-resistant engagement features carried by at least one of the inner base wall or the inner skirt. The closure assembly also includes a seal liner carried by the axially inboard surface of the inner base wall of the inner shell and positioned against the crown closure. The closure assembly further includes an outer shell including an outer base wall, an outer skirt depending from the outer base wall and having an internal retention bead for cooperating with the external retention bead of the inner shell to retain the shells together in an axial direction, and outer child-resistant engagement features carried by at least one of the outer base wall or the outer skirt to cooperate with the inner child-resistant engagement features of the inner shell.

DETAILED DESCRIPTION

According to the present disclosure, food or beverage packages are provided that are child-resistant (CR), pressurizable, and resealable, and that also may be tamper-evident.

Figure 1:
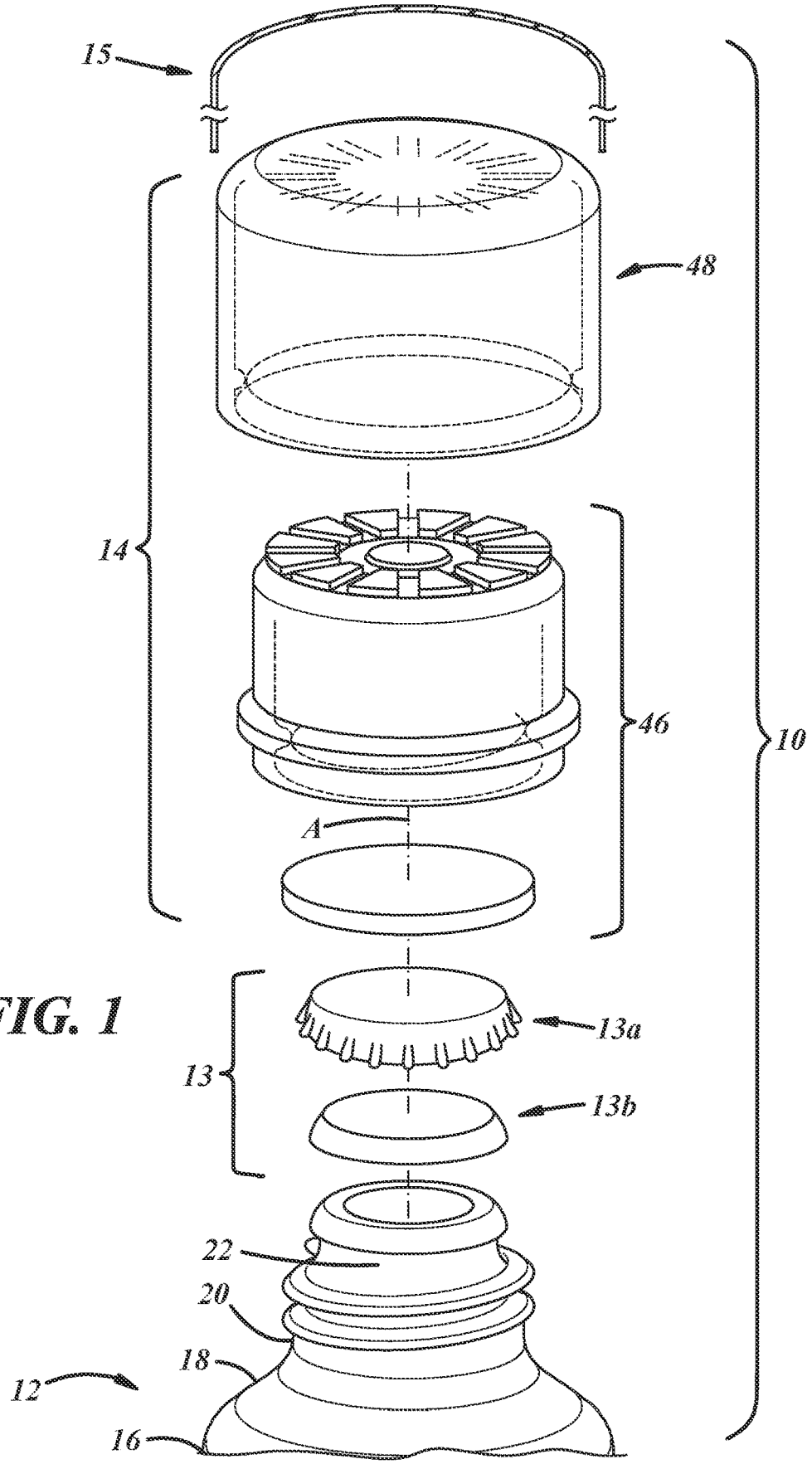
FIG. 1 is an exploded perspective view of a package including a container and a closure assembly in accordance with an illustrative embodiment of the present disclosure.

With specific reference to the drawing figures, FIG. 1 shows an illustrative embodiment of a food or beverage package 10 that is child-resistant (CR), pressurizable, and resealable, and that also may be tamper-evident. The package 10 includes a container 12, a crown closure 13 coupled to the container 12, and a multi-piece CR closure assembly 14 coupled to the container 12 over the crown closure 13. The package 10 also may include a tamper-evident shrink wrap or sleeve 15 applied over the closure assembly 14 and to the container 12. The package 10 includes a longitudinal axis A along which the container 12 generally longitudinally extends, and along which the crown closure 13 and the closure assembly 14 may be applied to and removed from the container 12, and about which a portion of the closure assembly 14 may be rotated. In one embodiment, the package 10 may include a beverage package, and may be used to contain pressurized liquid, for example, carbonated beverages, like beer, soda, champagne, sparkling wine, and others. Accordingly, the package 10 may be a closed beer package, closed soda package, closed wine/champagne package, or the like. In other embodiments, the package 10 may include any other type of closed container suitable for use with any food or beverage, or medicine, or any other suitable product, or for any other suitable purpose.

With continued reference to FIG. 1, the container 12 may be of one-piece integrally formed construction, preferably glass, plastic, or metal construction. The container 12 may be fabricated in press-and-blow or blow-and-blow glass container manufacturing operations, in a plastic injection and/or blow molding operation, in a metal drawing operation, or in any other suitable manner. The container 12 includes a base (not shown) on which the container 12 may be supported, a body 16 extending axially away from the base, a shoulder 18 extending radially inwardly and axially away from the body 16, and a neck 20 extending axially away from the shoulder 18. As used herein, the term "axial" includes oriented along a longitudinal axis of the closure assembly 14, container 12, or package 10, and may include but is not limited to a direction that is strictly parallel to such axis. Also, as used herein, directional words such as top, bottom, upper, upward, downward, lower, radial, circumferential, lateral, longitudinal, transverse, vertical, horizontal, and the like are employed by way of description and not necessarily limitation.

Figure 2:
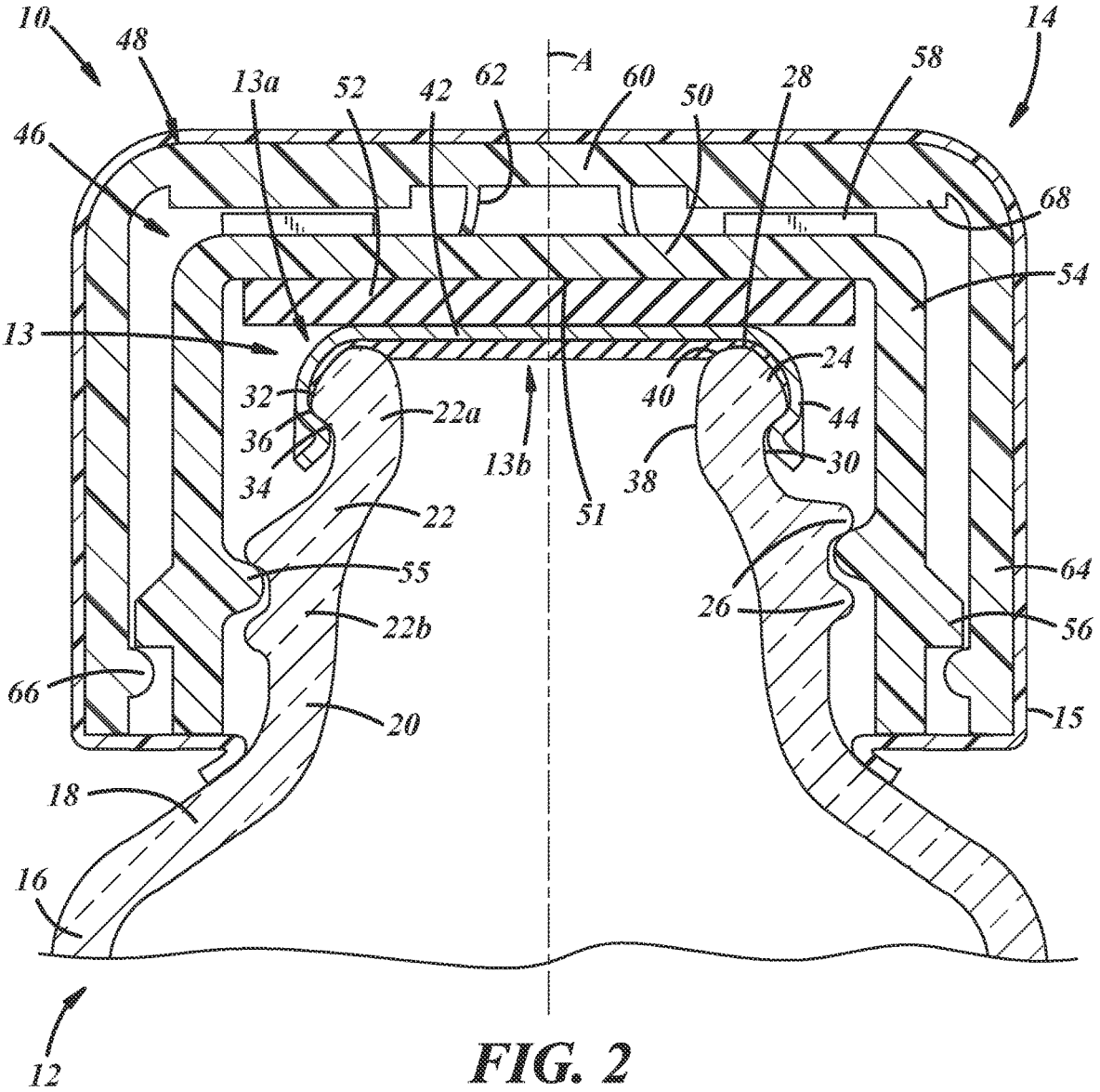
FIG. 2 is a cross-sectional view of the package of FIG. 1 in an assembled state.

With reference now to FIG. 2, the container neck 20 terminates in a unique neck finish 22 having a smaller diameter portion 22*a* with a crown closure bead 24 to accommodate the crown closure 13, and has a larger diameter portion 22*b* that is externally threaded with one or more external thread segments 26 at a location between the crown closure bead 24 and the container shoulder 18. The bead 24 may have a first outer diameter, and the thread segments 26 may have a second outer diameter larger than the first outer diameter. As used herein, the phrase "thread segment" includes whole, partial, multiple, and/or an interrupted thread and/or thread segment. The neck finish 22 also has an axial outwardly facing surface or lip 28, and an outer annular reduced diameter portion or relief 30 between the crown closure bead 24 and the larger diameter portion 22*b*. In the illustrated embodiment, the bead 24 is configured for a crimp-on/pry-off closure cap, is circumferentially continuous, and includes a radially and axially outwardly facing surface or flank 32, and a radially outwardly and axially inwardly facing undersurface or shoulder 34. The bead 24 further may include a transition surface 36, which may be rounded or excurvate, between the flank 32 and the undersurface 34 of the bead 24. In another embodiment, the bead 24 may be configured with one or more thread segments to accommodate coupling of a twist-off closure cap. The neck finish 22 also may include an inner annular surface or mouth 38, which may be axially spaced from the lip 28 by an internal excurvate surface or round 40, and which may be cylindrical.

The crown closure 13 may include a shell 13*a* and a separate liner 13*b* carried by an inside surface of the shell 13*a*. The shell 13*a* may be composed of metal, and the liner 13*b* may be composed of a polymeric material, for example, a foamed plastic such as polyethylene foam, molded polyethylene, PVC, EVA, rubber, or the like. The crown closure 13 includes a base wall 42 and a skirt 44 extending axially away from a radially outer periphery of the base wall 42. In this embodiment, the crown closure 13 may be applied to the neck finish 22 of the container 12 by any suitable crown capping equipment. In any event, once applied, and as those of ordinary skill in the art will appreciate, the crown closure 13 can render the package 10 pressurizable, for example, up to 5 gas volumes $CO_2$ without Pasteurization, or up to 3 gas volumes $CO_2$ with Pasteurization.

The multi-piece CR closure assembly 14 may include a two-shell closure, for example, including only two closure shells: an inner shell 46 and an outer shell 48 configured to be coupled to the inner shell 46. As will be described in further detail herein below, the inner and outer shells 46, 48 may be configured to operate in a push-and-turn CR manner wherein a user must apply a downward force to the outer shell 48 toward the inner shell 46 and then rotate the outer shell 48 in a counter-clockwise direction to remove the assembly 14 from the container 12. The assembly 14 is taller than it would otherwise be if the assembly 14 was being used with the container 12 without the crown closure 13.

The inner shell 46 has a base wall 50 extending transversely with respect to the axis A and having an axially inboard surface 51 carrying a seal liner 52, e.g., polymeric foam such as polyethylene foam, molded polyethylene, PVC, EVA, rubber, or the like, for resealing to the container 12 after the crown closure 13 has been removed from the container 12. The inner shell 46 also includes a skirt 54 depending from a radially outer periphery of the base wall 50 and having one or more internal thread segments 55 for cooperating with the one or more external thread segments 26 of the container neck finish 22 and also having one or more external retention lugs or beads 56 for cooperation with the outer shell 48. The inner shell 46 also includes one or more CR engagement features 58, for example, carried by the base wall 50. As used herein, the term "transverse" means disposed at some oblique angle with respect to a longitudinal axis of the closure, container, or package and along any direction intersecting the closure, container, or package, and may include but is not limited to a radial direction.

The outer shell 48 has a base wall 60 that may carry one or more springs 62, and an outer skirt 64 depending from a radially outer periphery of the base wall 60 and having one or more internal retention lugs or beads 66 for cooperating with the corresponding one or more external retention lugs or beads 56 of the inner shell 46 to retain the shells 46, 48 together in an axial direction. The outer shell 48 also includes one or more CR engagement features 68, which may be carried by the base wall 60.

The inner shell 46 is configured to be secured directly to the container 12 and to sealingly engage directly with the container 12. In contrast, the outer shell 48 is configured to be secured directly to the inner shell 46 but indirectly to the container 12. The inner and outer shells 46, 48 may be composed of polymeric material, or any other material suitable for use with, for instance, food or beverage packaging, and may be injection molded, compression molded, or produced in any other suitable manner.

The assembly 14 may be a push-and-turn CR assembly, wherein the inner and outer shells 46, 48 may include the cooperating push-and-turn CR engagement features 58, 68 and the spring(s) 62 to bias the shells 46, 48 axially apart from one another. Those of ordinary skill in the art will recognize that the spring(s) 62 are integral, but, in other embodiments, the spring(s) 62 could also or instead be carried by the inner shell 46 or could be one or more separate components. In any event, one or more springs 62 may be carried between the shells 46, 48 to bias the shells 46, 48 axially apart. In other embodiments, springs would not be necessary if CR lugs are configured with cooperating angled faces. The features 58, 68 may be comprised of circumferential arrays of lugs, cams, or other projections, or pockets or other recesses. In the illustrated example, an axially and radially outer portion of the base wall 50 of the inner shell 46 carries CR lugs 58, and the base wall 60 of the outer shell 48 carries CR lugs 68 for cooperating with the CR lugs 58 of the inner shell. In one example, the CR lugs 58 of the inner shell 46 may be ramped or cammed such that the CR lugs 68 of the outer shell 48 will simply ride over the lugs 58 of the inner shell 46 unless an amount of pushing force is applied to the outer shell 48 toward the inner shell 46 so as to engage the lugs 58, 68 in a manner sufficient to transmit torque from the outer shell 48 to the inner shell 46 sufficient to remove the closure assembly 14 from the container 12. Those of ordinary skill in the art will recognize that other push-and-turn CR features and closures may be used and may have any suitable configurations, sizes, and geometries suitable for push-and-turn CR functionality.

In assembly, the crown closure 13 may be applied to the container 12, and then the closure assembly 14 may be threaded to, or force fit over, the container neck finish 22 such that the cooperating thread segments 26, 55 engage each other, and thereafter the tamper-evident shrink sleeve 15 may be applied over the closure assembly 14 and to the container neck 20.

In use, the shrink sleeve 15 may be removed by tearing it away along pre-weakened lines or in any other manner. Then the outer shell 48 of the closure assembly 14 may be pushed in an axial direction against the inner shell 46 to sufficiently engage the CR engagement features 58, 68 and then may be rotated to remove the inner shell 46 from the container neck finish 22. Thereafter, the crown closure 13 may be twisted-off or pried away from the crown bead 24 to open the container 12 and thereby allow dispensing of product out of the container 12. Subsequently, the crown closure 13 may be discarded and the closure assembly 14 may be applied to the container 12 by locating the assembly 14 over the container neck finish 22 so as to engage the inner shell thread segments 55 with the neck finish thread segments 26 and pushing and turning the closure assembly 14 so as to threadingly secure the closure assembly 14 to the container 12 and so as to sealingly engage the inner shell seal liner 52 to the crown bead 24 to close the container 12 and reseal the package 10.

Figure 3:
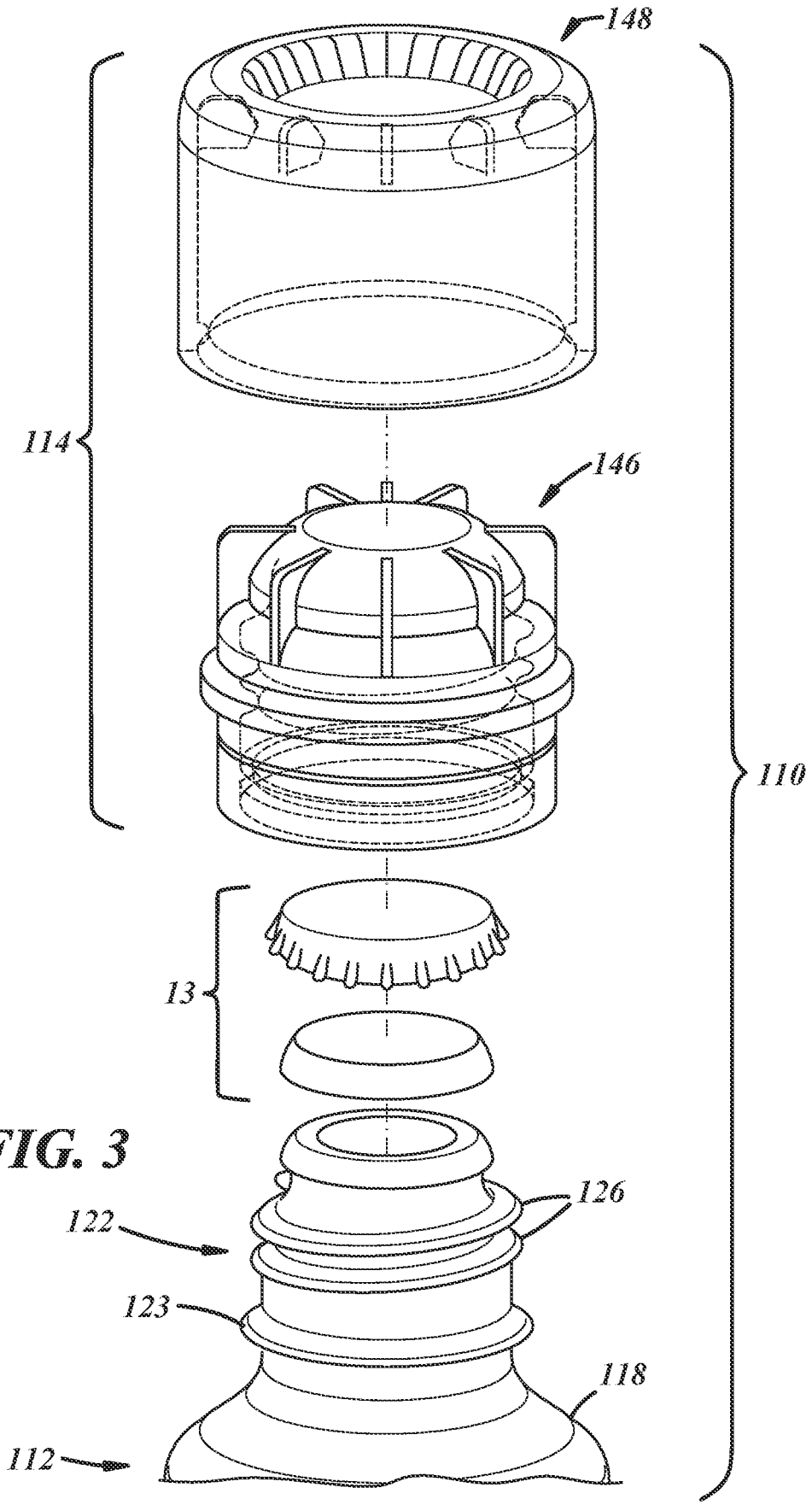
FIG. 3 is an exploded perspective view of a package including a container and a closure assembly in accordance with another illustrative embodiment of the present disclosure.
Figure 4:
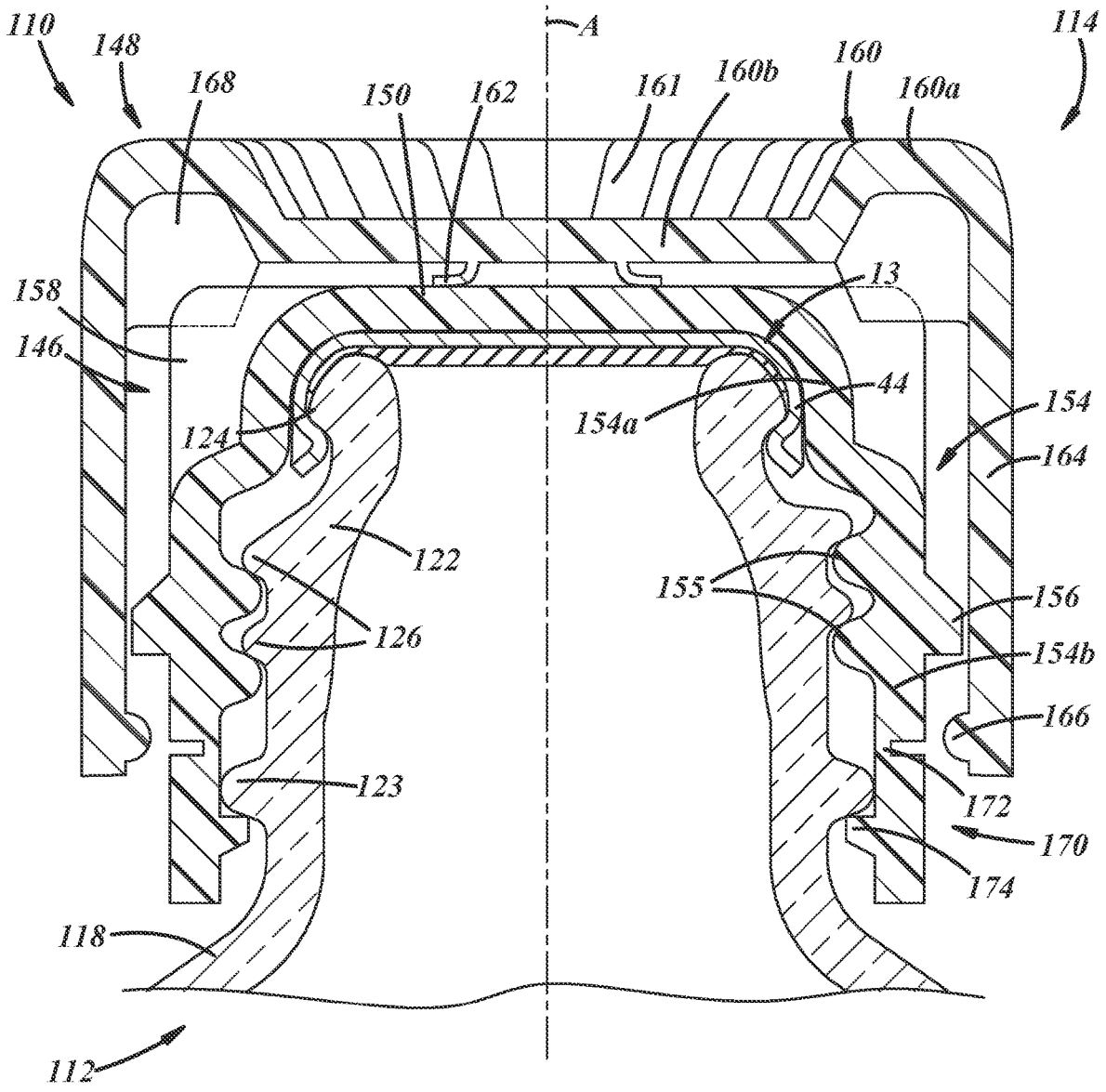
FIG. 4 is a cross-sectional view of the package of FIG. 3 in an assembled state.

FIGS. 3 and 4 show another illustrative embodiment of a package. This embodiment is similar in many respects to the embodiment of FIGS. 1 and 2 and like numerals among the embodiments generally designate like or corresponding elements throughout the several views of the drawing figures. Accordingly, the descriptions of the embodiments are incorporated into one another, and description of subject matter common to the embodiments generally may not be repeated here.

FIG. 3 shows an illustrative embodiment of a package 110 that is child-resistant (CR), pressurizable, and resealable, and that is also tamper-evident. The package 110 includes a container 112, the crown closure 13 coupled to the container, and a multi-piece closure assembly 114 configured to be coupled to the container 112 over the crown closure 13. In this embodiment, a tamper-evident shrink sleeve is not required.

The container 112 includes a neck finish 122 that is longer than that of the embodiment of FIGS. 1 and 2, and includes a tamper bead 123 between threads 126 and a shoulder 118. The closure assembly 114 includes an inner shell 146 and an outer shell 148. As will be described in further detail herein below, the inner and outer shells 146, 148 may be configured to operate in a push-and-turn CR manner wherein a user must apply a downward force to the outer shell 148 toward the inner shell 146 and then rotate the outer shell 148 in a counter-clockwise direction to remove the assembly 114 from the container 112.

With reference now to FIG. 4, the inner shell 146 includes a base wall 150 that may carry a seal liner (not shown) on an axially inboard surface thereof, and an inner skirt 154 extending away from a radially outer periphery of the base wall 150. The inner skirt 154 includes a first inner skirt portion 154*a* and a second inner skirt portion 154*b* radially larger than the first inner skirt portion 154*a* and extending away from a lower portion of the first inner skirt portion 154*a*. The inner shell 146 also includes one or more CR engagement features 158, which may include, for example, a circumferentially spaced array of wings as illustrated in FIGS. 3 and 4. The engagement features 158 may extend radially away from the base wall 150 and the first inner skirt portion 154*a* and axially away from the second inner skirt portion 154*b*. The second inner skirt portion 154*b* includes one or more internal thread segments 155 configured to thread to the one or more external thread segments 126 of the container 112, and one or more axial engagement features 156 configured to engage the outer shell 148 to retain the outer shell 148 to the inner shell 146. The feature(s) 156 may include one or more external shoulders projecting radially outwardly from a cylindrical wall of the second inner skirt portion 154*b*. Also, at a lower end of the inner skirt 154 of the inner shell 146, the inner shell 146 has a frangible tamper-evident band 170 for cooperating with the tamper-evident bead 123 on the container neck finish 122 below the thread segments 126. The band 170 includes frangible elements 172 connected to the lower end of the inner skirt 154 and one or more internal lugs or beads 174 to engage beneath the corresponding tamper-evident bead 123 of the container 112. Further, the inner skirt 154 of the inner shell 146 includes a radially inwardly facing surface in contact with the skirt 44 of the crown closure 13, and configured to crimp the skirt 44 of the crown closure 13 to a crown bead 124 of the container neck finish 122 when the multi-piece closure assembly 114 is threaded to the container neck finish 122. Additionally, the inner shell 146 may be configured to carry the crown closure 13 before being applied to the container 112. For example, at least the base wall 42 of the crown closure 13 may be carried radially within the first inner skirt portion 154*a* of the inner shell 146, such that the closure 13 is frictionally fit to the inner shell 146.

The outer shell 148 includes a base wall 160 extending transversely with respect to the axis A and including a radially outer portion 160*a* and an axially recessed central wall portion 160*b* establishing an axially outwardly facing pocket having at least one bottle opener feature. For example, the central wall portion 160*b* may carry crown closure engagement features 161. Accordingly, the multi-piece closure assembly 114 can be removed from the container 112, inverted, and positioned so that the crown closure engagement features 161 of the outer shell 148 are on top of and engaged to the crown closure 13 such that the closure assembly 114 can be used as a bottle opener to detach the crown closure 13 from the container neck finish 122 of the container 12. The outer shell 148 also includes a radially outer skirt 164 extending axially away from a radially outer periphery of the radially outer portion 160*a* of the base wall 160. The outer skirt 164 includes an inner shell engagement feature 166, which may include one or more internal shoulders or beads extending radially inwardly from a cylindrical wall of the outer skirt 164. The outer shell 148 also includes one or more CR engagement features 168, which may include, for example, wings as illustrated in FIGS. 3 and 4. The engagement features 168 may extend radially inwardly away from the outer skirt 164 and axially away from the base wall 160, and may be arranged in a circumferentially spaced array, for instance, a circumferentially equidistantly spaced array of wings. Further, the outer shell 148 may include one or more springs 162 to bias the outer shell 148 in a direction axially away from the inner shell 146.

In assembly, the crown closure 13 may be applied to the container 112, and then the closure assembly 114 may be threaded to, or force fit over, the container neck finish 122, such that the cooperating thread segments 126, 155 engage each other and so that the tamper-evident band 170 of the closure assembly 114 engages the tamper-evident bead 123 of the container 112.

In use, the outer shell 148 of the closure assembly 114 may be pushed in an axial direction against the inner shell 146 such that the CR engagement features 168 of the outer shell 148 axially overlap the CR engagement features 158 of the inner shell 146, thus allowing the CR engagement features 158, 168 to be circumferentially or rotatably engageable with one another. Accordingly, the outer shell 148 may be rotated so as to engage the CR engagement features 168, 158 and thereby rotate the inner shell 146 to first rupture the tamper-evident band 170 away from the rest of the inner shell 146, and then to remove the inner shell 146 from the container neck finish 122. Thereafter, the crown closure 13 may be twisted-off or pried away from the crown bead 124 to open the container 112 and allow dispensing of product out of the container 112. Subsequently, the crown closure 13 may be discarded and the closure assembly 114 may be applied to the container 112 by locating the assembly 114 over the container neck finish 122 so as to engage the inner shell thread segments 155 with the neck finish thread segments 126 and pushing and turning the closure assembly 114 so as to threadingly secure the closure assembly 114 to the container 112 and so as to sealingly engage the inner shell seal liner to the crown bead 124 to close the container 112 and reseal the package 110.

The disclosure has been presented in conjunction with several illustrative embodiments, and additional modifications and variations have been discussed. Other modifications and variations readily will suggest themselves to persons of ordinary skill in the art in view of the foregoing discussion. For example, the subject matter of each of the embodiments is hereby incorporated by reference into each of the other embodiments, for expedience. The disclosure is intended to embrace all such modifications and variations as fall within the spirit and broad scope of the appended claims.

The invention claimed is:

1. A package, comprising:

a container including a neck terminating in a neck finish having a crown closure bead with a first outer diameter, and at least one external thread segment spaced axially away from the crown closure bead and having a second diameter greater than the first outer diameter of the crown closure bead;

a crown closure coupled to the crown closure bead of the container neck finish and including:

a shell, and a seal liner carried by the shell, to provide a seal between the shell and the container; and a multi-piece closure assembly coupled to the crown closure and the container neck finish, and including:

an inner shell including:

an inner base wall having an axially inboard surface, an inner skirt depending from the base wall and having at least one internal thread segment to cooperate with the at least one external thread segment of the container neck finish and also having at least one external retention bead, and inner child-resistant engagement features carried by at least one of the inner base wall or the inner skirt; and an outer shell including:

an outer base wall, an outer skirt depending from the outer base wall and having an internal retention bead for cooperating with the external retention bead of the inner shell to retain the shells together in an axial direction, and outer child-resistant engagement features carried by at least one of the outer base wall or the outer skirt to cooperate with the inner child-resistant engagement features of the inner shell.

2. The package set forth in claim 1, wherein the inner child-resistant engagement features include a circumferential array of lugs projecting axially outwardly from the inner base wall, and wherein the outer child-resistant engagement features include a corresponding circumferential array of lugs projecting axially inwardly from the outer base wall.

3. The package set forth in claim 1, wherein the inner child-resistant engagement features include a circumferential array of wings projecting axially outwardly from the inner base wall, and wherein the outer child-resistant engagement features include a corresponding circumferential array of wings projecting axially inwardly from the outer base wall.

4. The package set forth in claim 1, wherein the multi-piece closure assembly also includes at least one spring carried between the inner and outer shells to bias the shells axially apart.

5. The package set forth in claim 1, further comprising a tamper-evident shrink wrap or sleeve applied over the closure assembly and to the container.

6. The package set forth in claim 1, wherein the outer base wall includes a recessed wall portion establishing an axially outwardly facing pocket having at least one bottle opener feature.

7. The package set forth in claim 1, wherein the inner skirt of the inner shell includes an inwardly facing surface in contact with a skirt of the crown closure, and configured to crimp the skirt of the crown closure to the crown bead of the container neck finish when the multi-piece closure is threaded to the container neck finish.

8. The package set forth in claim 1, wherein the inner shell is configured to carry the crown closure before being applied to the container.

9. The package set forth in claim 1, wherein a lower end of the inner skirt of the inner shell has a frangible tamper-evident band for cooperating with a tamper-evident bead on the container neck finish below the at least one external thread segment.

10. The package set forth in claim 1, wherein the container is composed of glass, the closure shells are composed of plastic, and the crown closure shell is composed of metal.

11. A package, comprising:

a container including a neck and a neck finish having a crown closure bead with a first outer diameter, and at least one external thread segment spaced axially away from the crown closure bead and having a second diameter greater than the first outer diameter of the crown closure bead;

a crown closure coupled to the crown closure bead of the container neck finish; and a multi-piece closure assembly coupled to the crown closure and the container neck finish, and including:

an inner shell including:

an inner base wall having an axially inboard surface, an inner skirt depending from the base wall and having at least one internal thread segment to cooperate with the at least one external thread segment of the container neck finish and also having at least one external retention bead, and a circumferential array of child-resistant engagement features projecting axially outwardly from the inner base wall;

a seal liner carried by the axially inboard surface of the inner base wall, and positioned against the crown closure; and an outer shell including:

an outer base wall, an outer skirt depending from the outer base wall and having an internal retention bead for cooperating with the external retention bead of the inner shell to retain the shells together in an axial direction, and a circumferential array of child-resistant engagement features projecting axially inwardly from the outer base wall.

12. The package set forth in claim 11, wherein the multi-piece closure assembly also includes at least one spring carried between the inner and outer shells to bias the shells axially apart.

13. The package set forth in claim 11, further comprising a tamper-evident shrink wrap or sleeve applied over the closure assembly and to the container.

14. The package set forth in claim 11, wherein the container is composed of glass, the closure shells are composed of plastic, and the crown closure shell is composed of metal.

15. A package, comprising:

a container including a neck and a neck finish having a crown closure bead with a first outer diameter, at least one external thread segment spaced axially away from the crown closure bead and having a second diameter greater than the first outer diameter of the crown closure bead, and a tamper-evident bead spaced axially away from the at least one thread segment;

a crown closure coupled to the crown closure bead of the container neck finish; and a multi-piece closure assembly coupled to the crown closure and the container neck finish, and including:

an inner shell including:

an inner base wall having an axially inboard surface, an inner skirt depending from the base wall and having at least one internal thread segment to cooperate with the at least one external thread segment of the container neck finish and also having at least one external retention bead, a circumferential array of child-resistant engagement features projecting radially outwardly from the inner base wall and the inner skirt, and a frangible tamper-evident band at a lower end of the inner skirt for cooperating with the tamper-evident bead on the container neck finish; and an outer shell including:

an outer base wall, an outer skirt depending from the outer base wall and having an internal retention bead for cooperating with the external retention bead of the inner shell to retain the shells together in an axial direction, and a circumferential array of child-resistant engagement features projecting axially and radially inwardly from the outer base wall and the outer skirt.

16. The package set forth in claim 15, wherein the outer base wall includes a recessed wall portion establishing an axially outwardly facing pocket having at least one bottle opener feature.

17. The package set forth in claim 15, wherein the inner skirt of the inner shell includes an inwardly facing surface in contact with a skirt of the crown closure, and configured to crimp the skirt of the crown closure to the crown bead of the container neck finish when the multi-piece closure is threaded to the container neck finish.

18. The package set forth in claim 15, wherein the inner shell carries the crown closure before being applied to the container.

19. The package set forth in claim 15, wherein the container is composed of glass, the closure shells are composed of plastic, and the crown closure shell is composed of metal.

20. The package set forth in claim 15, wherein the multi-piece closure assembly further includes:

a seal liner carried by the axially inboard surface of the inner base wall of the inner shell, and positioned against the crown closure.

21. The package set forth in claim 1, wherein the multi-piece closure assembly further includes:

an inner shell seal liner carried by the axially inboard surface of the inner base wall of the inner shell and positioned against the crown closure.

* * * * *